US006033291A

United States Patent [19]

Mathison et al.

[11] Patent Number: 6,033,291

[45] Date of Patent: Mar. 7, 2000

[54] OFFSET RAIL GRINDING

[75] Inventors: Dennis R. Mathison, Maple Plain; Tab A. Ashwill, Annandale, both of Minn.

[73] Assignee: Loram Maintenance of Way, Inc., Hamel, Minn.

[21] Appl. No.: 09/118,278

[22] Filed: Jul. 17, 1998

Related U.S. Application Data

[60] Provisional application No. 60/078,116, Mar. 16, 1998.

[51] Int. Cl.[7] ..... B24B 1/00; B24B 23/00

[52] U.S. Cl. ..... 451/57; 451/58; 451/65; 451/347; 15/54

[58] Field of Search ..... 451/57, 58, 65, 451/66, 347, 178; 15/54, 55

[56] References Cited

U.S. PATENT DOCUMENTS

| | | | |
|---|---|---|---|
| 4,135,332 | 1/1979 | Theurer . | |
| 4,205,494 | 6/1980 | Rivoire . | |
| 4,492,059 | 1/1985 | Paue Hi | 451/178 |
| 4,583,893 | 4/1986 | Liné | 451/347 |
| 4,615,150 | 10/1986 | Panetti . | |
| 4,751,794 | 6/1988 | Clem | 451/347 |
| 4,862,647 | 9/1989 | Vieau . | |
| 4,905,422 | 3/1990 | Panetti . | |
| 4,993,193 | 2/1991 | Panetti . | |
| 5,086,591 | 2/1992 | Panetti . | |
| 5,265,379 | 11/1993 | Panetti . | |

FOREIGN PATENT DOCUMENTS

| | | |
|---|---|---|
| 0145919 | 6/1985 | European Pat. Off. . |
| 0235602 | 9/1987 | European Pat. Off. . |
| 0344390 | 12/1989 | European Pat. Off. . |
| 2333897 | 7/1977 | France . |
| 2612173 | 6/1977 | Germany . |
| 2612174 | 6/1977 | Germany . |
| 606616 | 11/1978 | Switzerland . |
| 633336 | 11/1982 | Switzerland . |
| 675440 | 9/1990 | Switzerland . |
| 1151010 | 5/1969 | United Kingdom . |

*Primary Examiner*—Timothy V. Eley
*Assistant Examiner*—Willie Berry, Jr.
*Attorney, Agent, or Firm*—Patterson & Keough, P.A.

[57] ABSTRACT

A grinding stone for grinding a railhead surface of a rail includes abrasive material. The abrasive material has a first side surface and an opposed second side surface. The first and second sides surfaces are joined by a circumferential surface. The circumferential surface is transversely disposed with respect to at least the first side surface. The abrasive material presents a bevelled grinding surface extending from a substantially circular locus of points on the second side surface to a substantially circumferential locus of points on the circumferential surface. A method of re-profiling the railhead surface of a rail includes the steps of:

rotating at least one grinding stone;

bringing the bevelled grinding surface of the grinding stone into contact with the railhead surface; and advancing the grinding stone along the rail.

27 Claims, 4 Drawing Sheets

58
56
58a
62
50a
32
50b
62
56
58
58a
J
62a
I
62a
60
40
40
60
38
36
34

OFFSET RAIL GRINDING

RELATED APPLICATION

This application claims the benefit of U.S. Provisional Application No. 60/078,116, filed Mar. 16, 1998.

TECHNICAL FIELD

This invention relates to rail maintenance for railroad rails and light rail (LR) rails. More particularly, the present invention relates to an apparatus and method for grinding and re-profiling the working surface (railhead) of a rail.

BACKGROUND OF THE INVENTION

Rails in both railroad and light rail (typically, inner-metropolitan transport for persons) applications are subject to wear by the passage of trains over the rails. In particular, depressions in the upper surface of a rail may develop such that the railhead presents an undulating, corrugated surface. Moreover, the rail may develop burrs or otherwise lose its symmetrical profile (the profile that is transverse to the rail longitudinal axis). Maintenance of a smooth running surface on the railhead of a rail for railroad and light rail applications is important for reasons of safety, riding comfort, noise suppression, reduced maintenance of the track and track bed, and protection of the track, track bed and rolling stock.

Grinding machines for maintaining the railhead of rails in smooth, properly shaped condition are known. Such grinding machines generally comprise a plurality of rotatable grinding modules carried on a grinding vehicle and pulled by a locomotive or the like, and disposed in close proximity to the railhead surface of the rail. The grinding modules include rotatable, abrasive grinding stones that can be lowered into a position where a portion of the grinding stone bears on the rail surface. The grinding stones then grind and restore the surface of the railhead to a smooth properly profiled configuration.

In the past, there have been two types of grinding, commonly referred to as Type I and Type II. Type I grinding is as depicted in the prior art figures, FIG. 1*a* and FIG. 1*b*. As depicted, a grinding stone 10 is positioned on the railhead surface 14 of the rail 12 The grinding stone 10 is preferably approximately ten inches in diameter having a layer of grinding material 16 formed circumferential to a backing plate or hub 18. The grinding stone rotates about axis 20 as indicated by Arrow A in FIG. 1*a*. The grinding stone 16 rotates in a plane that is substantially coplanar with a vertical plane passed through the longitudinal axis of the rail 12. Type I grinding provides for surface grinding of the railhead. The grinding is moved in a longitudinal direction with the rail by advancing the carrying locomotive along the rail 12. Over time, the circumferential grinding surface 17 of the stone "dresses" to the rail, taking the shape of the railhead profile as depicted in FIG. 1*b*.

Type II grinding is utilized to profile the railhead of the rail. Profiling of a rail is accomplished by tilting the grinding module, and in particular, tilting the grinding stone 10 relative to the railhead 14 of the rail 12. Type II grinding is depicted in the prior art FIGS. 2*a*–2*c*. As depicted in FIGS. 2*a* and 2*b*, the grinding stone 10 is tilted in a more generally horizontal disposition, as compared to the vertical disposition of Type I grinding. Rotation of the grinding stone 10 is about axis 20 as indicated by Arrows B in FIGS. 2*a* and 2*b*. In Type II grinding, the grinding is performed such that the inner diameter 26 of the abrasive layer 16 is located generally over the railhead 14. Such grinding generates two potential contact areas 22, 24 in which the abrasive layer 16 may be in contact with the railhead 14 of the rail 12. At the contact areas 22, 24, the abrasive of the abrasive layer 16 is moving in a generally transverse direction to the longitudinal axis of the rail 12. Thus, the grinding surface of the abrasive layer 16 remains a flat surface and grinds a flat facet on the curved railhead surface 14.

In practice, as depicted in FIG. 2*c*, the profile of the railhead surface 14 of the rail 12 is re-profiled by a plurality of grinding stones 10 each set at a different angle with respect to the railhead 14 and each grinding a relatively small facet of the profile of the railhead 14. In some prior art devices, as many as one hundred grinding stones are utilized to re-profile the railhead 14 of the rail 12.

Examples of Type II rail grinding machines having tiltable grinding modules include U.S. Pat. No. 4,622,781 to Vieau et al. (assigned to the assignee of the present invention), U.S. Pat. No. 4,178,724 to Bruno, U.S. Pat. No, 3,707,808 to Danko et al., U.S. Pat. No. 3,606,705 to Rivorire, U.S. Pat. No. 2,197,729 to Miller, and U.S. Pat. No. 2,132,470 to Hobson et al.

A problem with Type I grinding is that it necessarily must be performed at relatively low revolutionary speed of the grinding stone 16. When using a relatively large diameter stone, such speed is typically in the range of 600–650 rpm. The Type I grinding results in longitudinal grooves being formed in the railhead surface 14. Further, due to slight imbalance of the grinding stone 16, chatter marks having a relatively long wavelength are frequently defined in the railhead surface 14. Such chatter marks are undesirable because they increase the noise of a vehicle riding on the rails 12 and increase noise and vibration in a rail car that is supported on wheels as the wheels pass over the chatter marks. The wavelength of the chatter marks is directly related to the rotational speed of the grinding stone 16 and the rate of advance of a grinding vehicle that carries the grinding module, a relatively slow rotational speed in combination with relatively slow speed of advance generating relatively long wavelength chatter marks.

Type II grinding is normally done at a much higher revolving speed, typically in the range of 3,000–3,600 rpm. Such high rotational speed results in chatter marks being defined on the surface of the railhead that have a much shorter wavelength than is normally experienced with Type I grinding. The short wavelength of the Type II grinding chatter results in such chatter being relatively imperceptible from an increased noise and increased vibration standpoint. A problem that occurs with Type II grinding, however, is the fact that when such grinding is complete, the profile of the surface of the railhead is defined by a plurality of facets. It would be preferable if the surface 14 of the railhead was formed of a continuous smooth profile.

An additional problem arises with respect to re-profiling LR or tram rail. As indicated above, LR refers specifically to transit systems typically installed in large metropolitan areas primarily for the transportation of persons. LR rail is depicted in the prior art Figure, FIG. 3. LR rail 30 has a profiled railhead surface 32. Unlike the railroad rail 12, depicted in FIGS. 1 and 2, LR rail 30 has an upward directed flange 34 on the gage (inner) side of the LR rail 30. The flange 34 has an upper surface that is generally coplanar with the surface of the railhead surface 32.

A difficulty with profiling LR rail 30 using the Type II grinding as described above, arises when attempting to profile the gage shoulder 36 and the field shoulder 38. When a grinding stone 10 is disposed at a large included angle with respect to the LR rail 30 in order to profile the gage shoulder 36, the outer circumference of the grinding wheel 10 comes into contact with the flange 34. Additionally, LR rail 30 is typically laid in paved areas, having pavement 40 disposed along side the LR rail 30. The pavement 40 is used to present a generally uninterrupted horizontal surface to facilitate pedestrian traffic and automobile traffic over the LR rail 30. When a grinding stone is disposed at a high included angle with respect to LR rail 30 in order to profile the field shoulder 38, the outer circumference of the grinding stone 10 bears upon the guard 40. Accordingly, there is a need to be able to profile the railhead 32 of LR rail 30 without also grinding on the flange 34 or the pavement 40.

SUMMARY OF THE INVENTION

The present invention provides for offset grinding of a railhead, where a vertical line passed through the center of the grinding stone, when the grinding stone is in position to grind the railhead, is offset from the rail and does not intersect the rail. The vertical line is offset to a position such that the contact surface of the grinding stone is moving in a direction that is generally parallel to the longitudinal axis of the rail, such that, at a locus of contact of the stone with the railhead, a tangent to a path of rotation of the grinding stone is substantially parallel to the longitudinal axis of the rail. Thus, the stone surface contacting the rail "dresses" to the rail profile as in Type I grinding and distinct from the flat grinding surface of Type II grinding.

In a preferred embodiment, the grinding stone of the present invention is angled with respect to the railhead and has a beveled contact surface defined in the abrasive layer of the grinding stone such that a substantial portion of the railhead is simultaneously ground by the grinding stone. By utilizing two cooperative grinding stones, one angled inward on the gage side of the rail and one angled outward on the field side of the rail, the entire railhead can be smoothly profiled. The grinding stone of the present invention is operated at high rotational speed, approximately 3,500 rpm, thereby minimizing the wavelength of any chatter marks formed on the railhead. Additionally, it has been determined that grinding stone life when operated in the manner of the present invention is comparable to grinding stone life experienced in the past when performing Type II profiling.

The present invention is a grinding stone for grinding a railhead surface of a rail, including abrasive material. The abrasive material has a first side surface and an opposed second side surface. The first and second side surfaces are joined by a circumferential surface. The circumferential surface is transversely disposed with respect to at least the first side surface. The abrasive material presents a bevelled grinding surface extending from a substantially circular locus of points on the second side surface to a substantially circumferential locus of points on the circumferential surface. Further, the present invention is a method of re-profiling the railhead surface of a rail that includes the steps of:

rotating at least one grinding stone;

bringing a bevelled grinding surface of the grinding stone into contact with the railhead surface; and advancing the grinding stone along the rail.

DETAILED DESCRIPTION OF THE DRAWINGS

Figure 4:
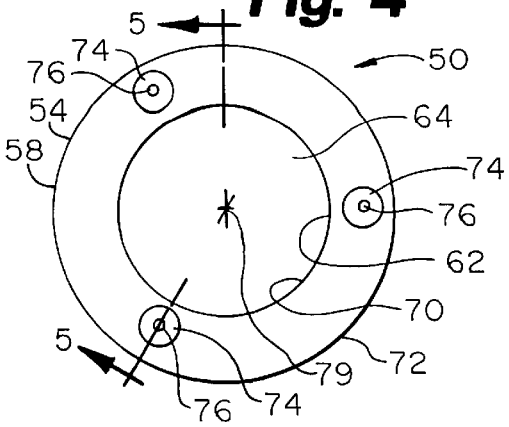
FIG. 4 is a side elevational view of the grinding stone of the present invention, depicting the backing plate.
Figure 5:
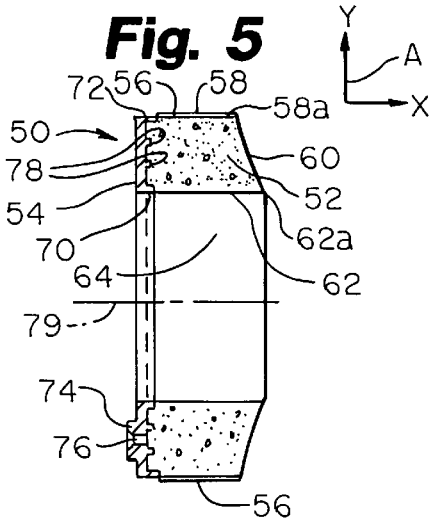
FIG. 5 is a sectional view of the grinding stone of the present invention taken along line 5—5 of FIG. 4.

The grinding stone of the present invention is shown generally at 50 in FIGS. 4 and 5. Grinding stone 50 has two major components: abrasive ring 52 and backing plate 54.

The abrasive ring 52 is preferably formed of a baked abrasive material. A sheath of fiberglass stranding 56 is preferably formed on the outer circumference 58 of the abrasive ring 52. In a preferred embodiment, the fiberglass stranding 56 is placed on the abrasive ring 52 prior to baking of the abrasive ring 52. The fiberglass stranding 56 is then cured along with the abrasive ring 52 during baking. An inner circular cavity 64 is defined by the inner circumference 62 of the abrasive ring 52 and is open to the right, as depicted in FIG. 5, and closed to the left by the backing plate 54.

A beveled grinding surface 60 extends between the outer circumference 58 and the inner circumference 62 of the abrasive ring 52. The grinding surface 60 has its inner and outer circumferences defined by the points 62*a* and 58*a*, respectively. The point 62*a* on the inner circumference defines a substantially circular locus of points on the side surface of the abrasive ring 52. The point 58*a* on the circumferential surface 58 defines a substantially circumferential locus of points on the circumferential surface 58. The beveling of the grinding surface 60 is such that the dimension from the backing plate 54 to the grinding surface 60 is greater when taken at the inner circumference 62 (point 62*a*) than when taken at the outer circumference 58 (point 58*a*) of the abrasive ring 52.

The grinding surface 60, in addition to being beveled, is preferably also radiused. The radius of the grinding surface 60 presents a concave surface. The concave surface of the grinding surface 60 is formed to generally conform to the desired profile of the railhead surface 14. With reference to the X-Y coordinate A of FIG. 5, the radius that defines the curved surface of the grinding surface 60 has its origin between 4 and 10 inches right of the point 62*a*, as depicted in FIG. 5. The Y dimension of the origin is between 1 inch and 5 inches from the point 58*a* of the abrasive ring 52. The radius is preferably between five and ten inches. Most preferably, the X dimension is substantially 7 inches and the Y dimension is substantially 1.25 inches, yielding a radius of substantially 7.75 inches.

The backing plate 54 is preferably a metal ring having an inner circumference 70 that is substantially equal to the inner circumference 62 of the abrasive ring 52 and an outer circumference 72 that is substantially equal to the outer circumference 58 of the abrasive ring 52. A plurality of raised attaching points 74 are formed on the surface of the backing plate 54. Each of the attaching points 74 has a threaded bore 76 defined therein. The backing plate 54 has inwardly directed circular rings 78. The circular rings 78 provide additional surface to assist the abrasive material that forms the abrasive ring 52 to bond to the backing plate 54. A center axis 79, also the axis of rotation of the grinding stone 50, passes centrally through the backplate 54.

Figure 6:
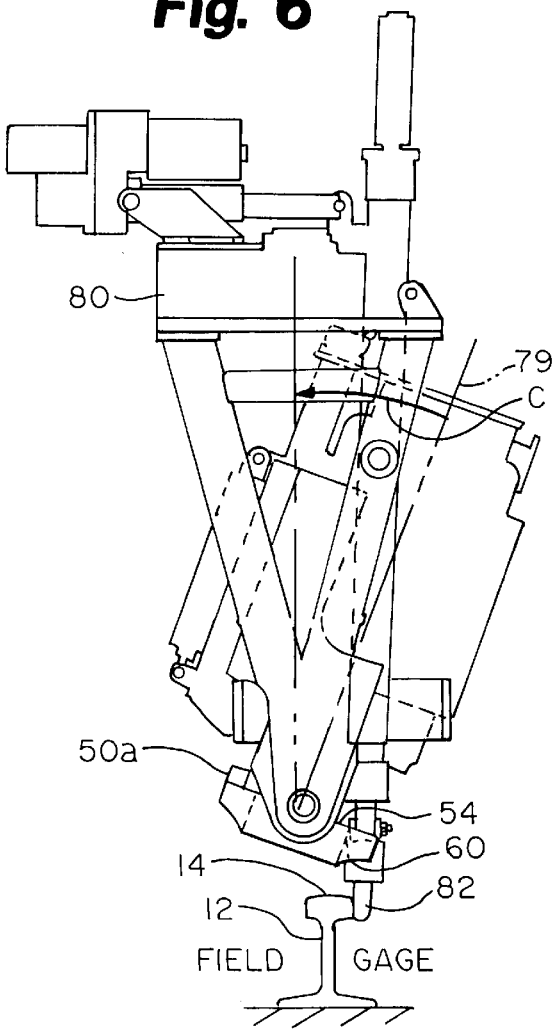
FIG. 6 is an end-on elevational view of a grinding stone of the present invention coupled to a grinding module and positioned with respect to a rail to provide profiling on the gage side of the rail.
Figure 7:
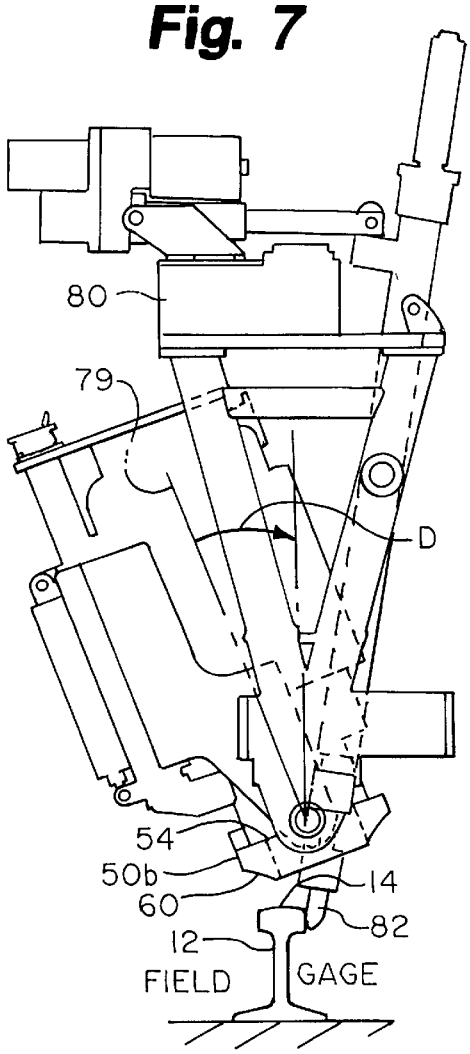
FIG. 7 is an end-on elevational view of a grinding stone of the present invention coupled to a grinding module and positioned with respect to a rail to provide profiling on the field side of the rail.

Referring to FIGS. 6 and 7, the grinding stone 50 of the present invention is depicted mounted on a grinding head 80. FIG. 6 depicts the grinding stone 50 poised to grind the gage side (the right side of FIG. 6) of the railhead 14 of the rail 12. FIG. 7 depicts the grinding stone 50 poised to grind the field side (the left side as depicted in FIG. 7) of the railhead 14 of the rail 12. A rotatable sensor 82 rides on the gage side of the rail 12 in order to correctly position the grinding head 80 with respect to the railhead 14. The grinding head 80 as depicted in FIGS. 6 and 7 is known in the art. The grinding head 80 typically imparts rotational motion to the grinding stone 50 by means of an electrically driven motor.

It should be noted that the angle C between the center axis 79 (a line drawn parallel to the plane of the backing plate 54) and a horizontal line when grinding on the gage side of the railhead 14 (depicted in FIG. 6) is substantially equal to the angle D between the center axis 79 (a line drawn parallel to the plane of the backing plate 54) and a horizontal line when grinding on the field side of the railhead 14 (depicted in FIG. 7).

Figure 8:
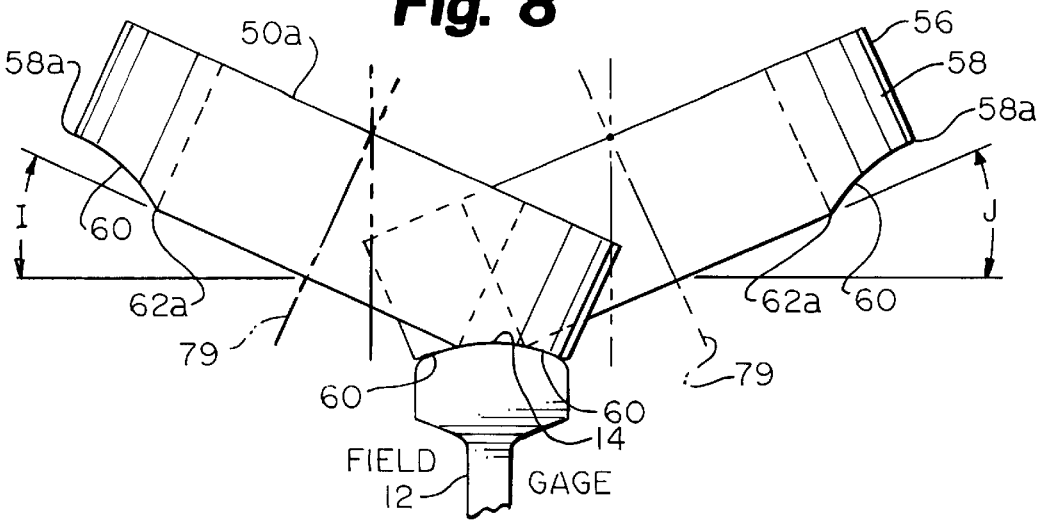
FIG. 8 is an end-on elevational view of two grinding stones of the present invention as depicted in FIGS. 6 and 7 disposed to profile the railhead of a railroad rail.
Figure 8A:
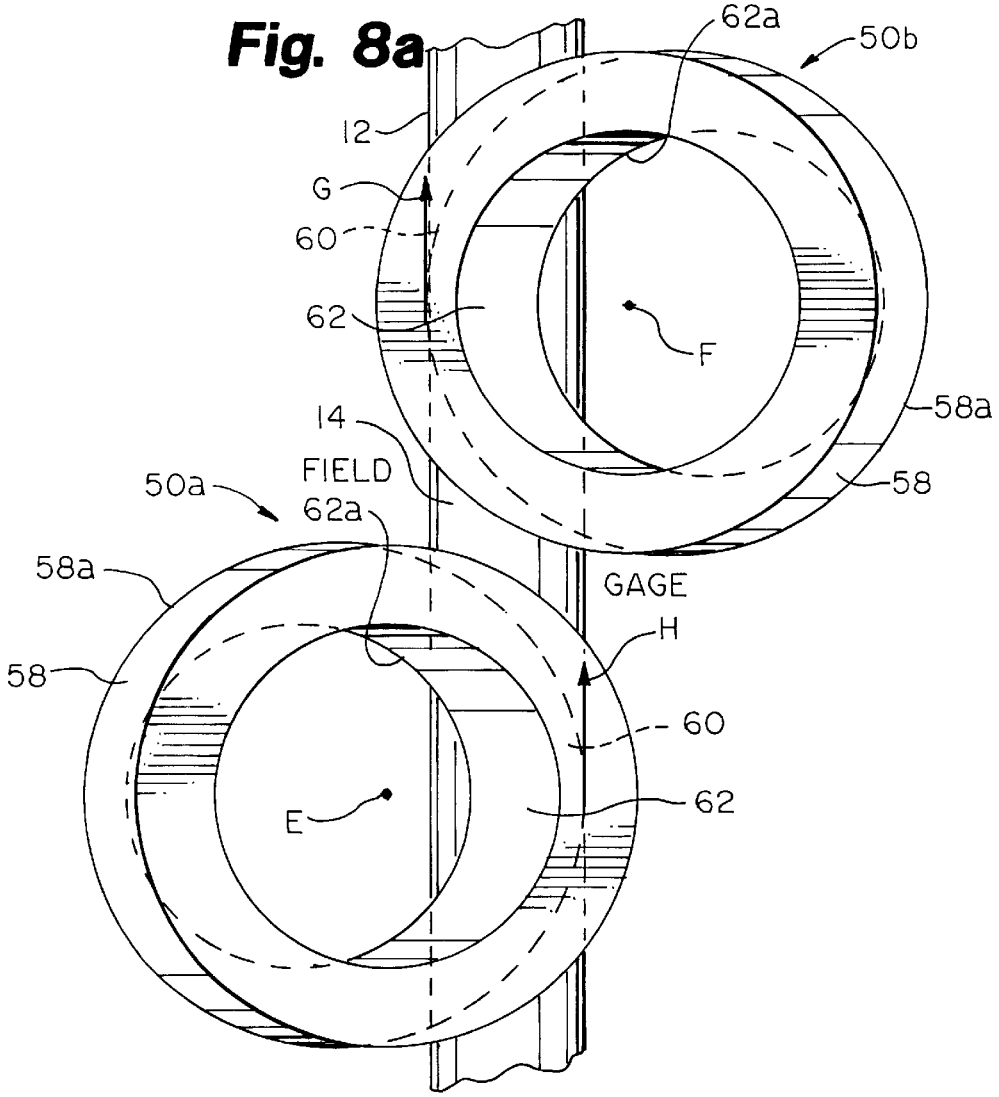
FIG. 8*a* is a top planview of the two grinding stones of FIG. 8 poised over the railhead with the respective backplates removed for clarity.

FIG. 8 depicts the cooperative profiling of the grinding stones 50*a*, 50*b* depicted in FIGS. 6 and 7 to effect a complete re-profiling of the railhead 14. Such re-profiling does not appreciably change the existing profile, but is effective to remove surface defects and corrugations that may have formed due to the passage of rail wheels. As depicted in FIGS. 6–8, the grinding stone 50*a* is utilized to profile the gage side portion of the railhead 14 and grinding stone 50*b* is utilized to re-profile the field side portion of the railhead 14. As depicted in FIGS. 8 and 8*a*, a vertical line E passed through the center axis 84 of the grinding stone 50*a* is offset from the rail 12 on the field side. Likewise, a vertical line F passed through the center axis 86 of the grinding stone 50*b* is offset from the rail 12 on the gage side. In FIG. 8*a* the tangents G and H to the path of rotation of the grinding stones 50*a*, 50*b* are parallel to the longitudinal axis I of the rail 12.

The difference in the angle of approach of the grinding stones 50*a*, 50*b* with respect to the railhead 14 is depicted in FIGS. 8 and 8*a*. Grinding stone 50*a* for grinding on the gage side portion of the railhead 14 is operated at an included angle I between the horizontal and a line parallel to the backing plate 54 that is between 15 degrees and 45 degrees. In a preferred embodiment, the grinding stone 50*a* is operated at an acute included angle I of 30 degrees.

Grinding stone 50*b* is generally operated at a steeper angle with respect to the horizontal for grinding the field side portion of the railhead 14. Grinding stone 50*b* is operated at an included angle J defined between a line parallel to the plane of the backing plate 54 and the horizontal of between 10 and 45 degrees. In a preferred embodiment, grinding stone 50*b* is operated at an included angle J of 22 degrees.

Figure 9:
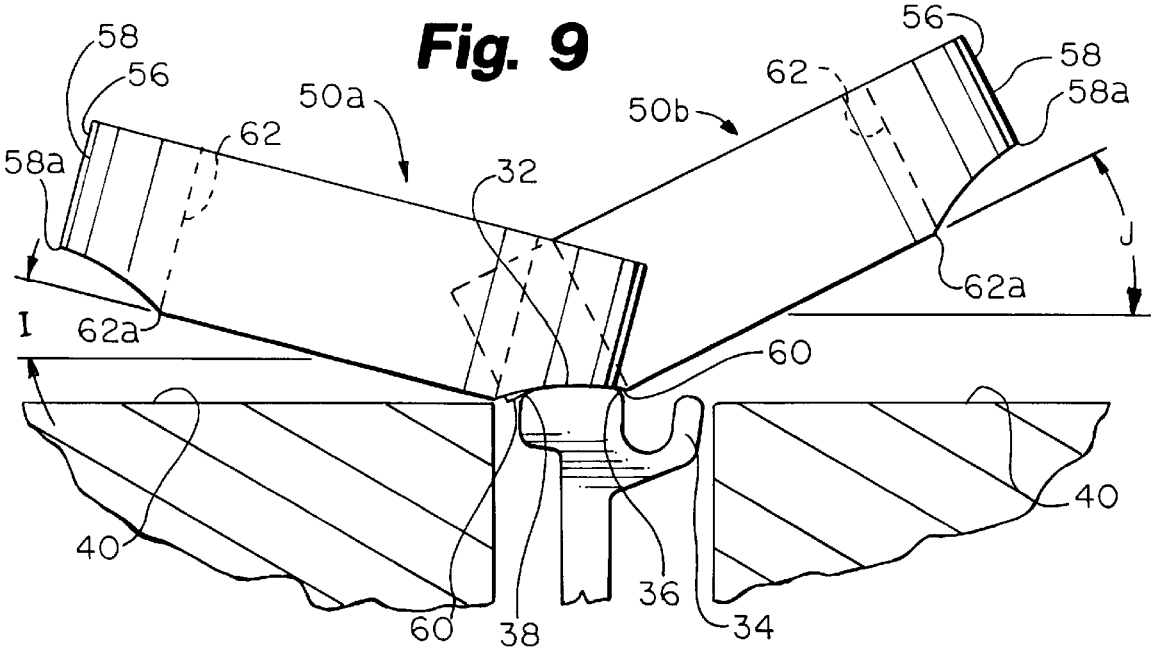
FIG. 9 is two grinding stones of the present invention disposed to profile the railhead of a LR rail.

Referring to FIG. 9, the grinding stones 50*a*, 50*b* are disposed similarly to the angular disposition depicted in FIG. 8 in order to grind the railhead 32 of a LR rail 30. As can be seen, the entire working surface of the railhead 32 can be re-profiled by the two cooperative stones 50*a*, 50*b* grinding on the respective field and gage portions of the railhead 32. The railhead 32 can be re-profiled using the offset grinding of the present invention without interfering with either the flange 34 of the LR rail 30 or the pavement 40 positioned on either side of the LR rail 30.

Figure 1A:
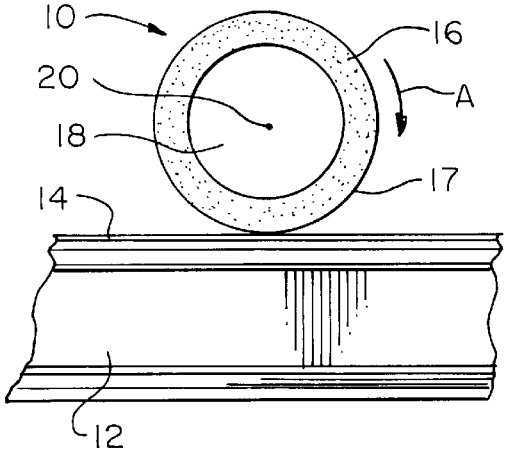
Fig. 1a PRIOR ART
FIG. 1*a* is a side elevational view of a prior art grinding stone performing Type I surfacing on a rail.
Figure 1B:
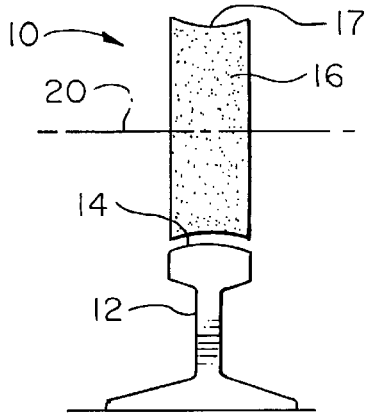
Fig. 1b PRIOR ART
FIG. 1*b* is an end-on elevational view of the prior art grinding stone of FIG. 1*a;*
Figure 2A:
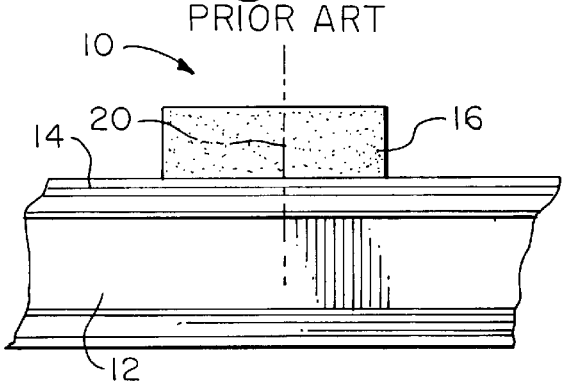
Fig. 2a PRIOR ART
FIG. 2*a* is a side elevational view of a prior art grinding stone in a generally horizontal disposition performing Type II profiling on a rail.
Figure 2B:
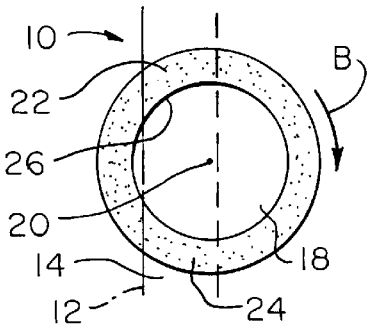
Fig. 2b PRIOR ART
FIG. 2*b* is a top plan form view of the prior art grinding stone of FIG. 2*a;*
Figure 2C:
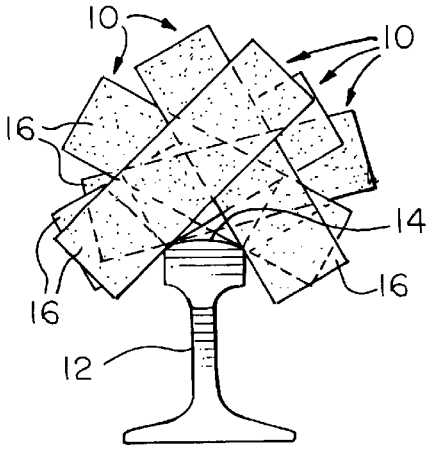
Fig. 2c PRIOR ART
FIG. 2*c* is an end-on elevational view of a plurality of prior art grinding stones oriented at differing angles with respect to the rail in order to perform Type II profiling of the railhead, each grinding stone grinding a different facet on the railhead.
Figure 3:
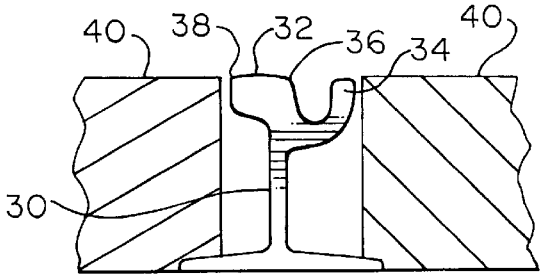
Fig. 3 PRIOR ART
FIG. 3 is an end-on elevational view of a prior art LR rail disposed between pavement.

In operation, with reference to FIGS. 6 and 7, the respective grinding stones 50*a*, 50*b* are advanced along the line 79 that is disposed transverse to the plane of the backplate 54 by the grinding module 80 until the grinding surface 60 comes into contact with the railhead surface 14. In a preferred embodiment, at least two grinding modules 80 are employed for each of the rails 12. One of the two grinding modules 80 for grinding a rail 12 is disposed as depicted in FIG. 6 and the second of the two grinding modules 80 for grinding the same rail 12 is disposed as depicted in FIG. 7. This provides for overlapping coverage of the entire railhead surface 14, as depicted in FIGS. 8 and 9. In addition to re-profiling the railhead surface 14, the overlapping coverage of the grinding stones 50*a*, 50*b* may be used to clean up the plurality of facets left on the coarsely re-profiled railhead surface 14 after Type II grinding has been performed, as depicted in prior art FIG. 2*c*.

The present invention is not to be limited to the details of construction described above and depicted in the accompanying figures as these details may be modified without departing from the principles of the invention.

What is claimed is:

1. A grinding machine for grinding a railhead surface of a rail, the rail having a gage side and a field side, the railhead surface presenting a generally curved surface extending between a point of intersection with a gage side surface and a point of intersection with a field side surface, comprising:

at least a first substantially cylindrical grinding stone having an outer cylindrical circumference and an inner cylindrical circumference defined about a grinding stone center axis, the grinding stone being disposable on the gage side of the rail having a grinding surface for being selectively contactable with at least a first portion of the railhead surface, the grinding surface of the grinding stone acting to affect surface characteristics of the railhead surface when in rotational contact with the railhead surface, the grinding surface being defined between the inner cylindrical circumference and outer cylindrical circumference, the grinding stone being advanced along the grinding stone center axis to engage the railhead surface, the grinding stone center axis being offset with respect to the rail such that an extension of the grinding stone center axis does not intersect the rail; and at least a second substantially cylindrical grinding stone having an outer cylindrical circumference and an inner cylindrical circumference defined about a grinding stone center axis, the grinding stone being disposable on the field side of the rail having a grinding surface for being selectively contactable with at least a second portion of the railhead surface, the grinding surface of the grinding stone acting to affect surface characteristics of the railhead surface when in rotational contact with the railhead surface, the grinding surface being defined between the inner cylindrical circumference and the outer cylindrical circumference, the grinding stone being advanced along the grinding stone center axis to engage the railhead surface, the grinding stone center axis being offset with respect to the rail such that an extension of the grinding stone center axis does not intersect the rail.

2. The grinding machine of claim 1 wherein the at least a first and second grinding stones act cooperatively to affect the surface characteristics of substantially the entire railhead surface.

3. The grinding machine of claim 1 wherein the first portion of the railhead surface contacted by the first grinding stone overlaps the second portion of the railhead surface contacted by the second grinding stone.

4. The grinding machine of claim 1 wherein the first grinding stone is selectively disposable at an included angle defined between a line substantially vertically orthogonal with respect to a longitudinal axis of the rail and a center axis of the grinding stone of between 15 degrees and 45 degrees.

5. The grinding machine of claim 4 wherein the first grinding stone is selectively disposable at an included angle defined between a line substantially vertically orthogonal with respect to a longitudinal axis of the rail and a center axis of the grinding stone of substantially 30 degrees.

6. The grinding machine of claim 1 wherein the second grinding stone is selectively disposable at an included angle defined between a line substantially vertically orthogonal with respect to a longitudinal axis of the rail and a center axis of the grinding stone of between 10 degrees and 45 degrees.

7. The grinding machine of claim 6 wherein the second grinding stone is selectively disposable at an included angle defined between a line substantially vertically orthogonal with respect to a longitudinal axis of the rail and a center axis of the grinding stone of substantially 22 degrees.

8. The grinding machine of claim 1 wherein the first and second grinding stones are formed substantially identically, the grinding stones having abrasive material, the abrasive material having a first side surface and an opposed second side surface, the first and second sides surfaces being joined by a circumferential surface, the circumferential surface being transversely disposed with respect to at least the first side surface, the abrasive material presenting a bevelled grinding surface extending from a substantially circular locus of points on the second side surface to a substantially circumferential locus of points on the circumferential surface.

9. The grinding machine of claim 8 wherein the grinding stone circumferential locus of points on the grinding stone circumferential surface is less distant from the first side surface than the circular locus of points on the second side surface.

10. The grinding machine of claim 8 wherein the grinding surface of the first and second grinding stones is radiused, presenting a concave surface.

11. The grinding machine of claim 10 wherein the grinding stone concave grinding surface is defined by a segment of an arc having a radius of from five to ten inches.

12. The grinding machine of claim 11 wherein the concave grinding surface is defined by a segment of an arc having a radius of substantially 7.75 inches.

13. The grinding machine of claim 1 wherein the first and second grinding stones are rotated at relatively high speed when grinding the railhead surface.

14. The grinding machine of claim 13 wherein the first and second grinding stones are rotated at substantially 3500 revolutions per minute when grinding the railhead surface.

15. A method of offset grinding a railhead surface of a rail, the rail having a gage side and a field side, the railhead surface presenting a generally curved surface extending between a point of intersection with a gage side surface and a point of intersection with a field side surface, comprising the steps of:

disposing a first substantially cylindrical grinding stone having an outer cylindrical circumference and an inner cylindrical circumference defined about a grinding stone center axis on the gage side of the rail, the grinding stone having a grinding surface for contacting at least a first portion of the railhead;

rotating the first grinding stone;

advancing the grinding stone along the grinding stone center axis to engage the railhead surface the grinding stone center axis being offset with respect to the rail such that an extension of the grinding stone center axis does not intersect the rail;

disposing a second substantially cylindrical grinding stone having an outer cylindrical circumference and an inner cylindrical circumference defined about a grinding stone center axis on the field side of the rail, the grinding stone having a grinding surface for contacting at least a second portion of the railhead;

rotating the second grinding stone; and advancing the grinding stone along the grinding stone center axis to engage the railhead surface, the grinding stone center axis being offset with respect to the rail such that an extension of the grinding stone center axis does not intersect the rail.

16. The method of claim 15 including the step of the first and second grinding stones acting cooperatively to affect the surface characteristics of substantially the entire railhead surface.

17. The method of claim 15 including the step of the first portion of the railhead surface contacted by the first grinding stone overlapping the second portion of the railhead surface contacted by the second grinding stone.

18. The method of claim 15 including the step of selectively disposing the first grinding stone at an included angle defined between a line substantially vertically orthogonal with respect to a longitudinal axis of the rail and a center axis of the grinding stone of between 15 degrees and 45 degrees.

19. The method of claim 15 including the step of selectively disposing the first grinding stone at an included angle defined between a line substantially vertically orthogonal with respect to a longitudinal axis of the rail and a center axis of the grinding stone of substantially 30 degrees.

20. The method of claim 15 including the step of selectively disposing the second grinding stone at an included angle defined between a line substantially vertically orthogonal with respect to a longitudinal axis of the rail and a center axis of the grinding stone of between 10 degrees and 45 degrees.

21. The method of claim 20 including the step of selectively disposing the second grinding stone at an included angle defined between a line substantially vertically orthogonal with respect to a longitudinal axis of the rail and a center axis of the grinding stone of substantially 22 degrees.

22. The method of claim 15 including the step of forming the first and second grinding stones substantially identically, the grinding stones having abrasive material, the abrasive material having a first side surface and an opposed second side surface, the first and second sides surfaces being joined by a circumferential surface, the circumferential surface being transversely disposed with respect to at least the first side surface, the abrasive material presenting a bevelled grinding surface extending from a substantially circular locus of points on the second side surface to a substantially circumferential locus of points on the circumferential surface.

23. The method of claim 22 including the step of radiusing the grinding surface of the first and second grinding stones, the radiused grinding surface presenting a concave surface.

24. The method of claim 22 including the step of radiusing the grinding surface of the first and second grinding stones with a radius of from five to ten inches.

25. The method of claim 24 including the step of forming the grinding surface of the first and second grinding stones to define the concave grinding surface by a segment of an arc having a radius of substantially 7.75 inches.

26. The method of claim 24 including the step of rotating the first and second grinding stones at relatively high speed when grinding the railhead surface.

27. The method of claim 26 including the step of rotating the first and second grinding stones at substantially 3500 revolutions per minute when grinding the railhead surface.

* * * * *